United States Patent [19]

Matsubara et al.

[11] 4,234,296

[45] Nov. 18, 1980

[54] SCREW COMPRESSOR

[75] Inventors: Katsumi Matsubara; Shigekazu Nozawa; Masaharu Ishii; Mitsuhiko Miyagawa, all of Shimizu, Japan

[73] Assignee: Hitachi, Ltd., Japan

[21] Appl. No.: 46,025

[22] Filed: Jun. 6, 1979

[30] Foreign Application Priority Data

Jun. 14, 1978 [JP] Japan ..... 53-70945

[51] Int. Cl.[3] ..... F01C 1/16; F04C 2/00

[52] U.S. Cl. ..... 418/201; 418/159

[58] Field of Search ..... 418/201, 159; 417/440

[56] References Cited

U.S. PATENT DOCUMENTS

| | | | |
|---|---|---|---|
| 3,314,597 | 4/1967 | Schibbye et al. | 220/138 |
| 3,656,876 | 4/1972 | Kocher | 418/201 |
| 3,885,402 | 5/1975 | Moody et al. | 418/201 |
| 3,913,346 | 10/1975 | Moody et al. | 62/197 |
| 3,936,239 | 2/1976 | Shaw | 418/201 |
| 4,062,199 | 12/1977 | Kasahara et al. | 418/201 |

FOREIGN PATENT DOCUMENTS

| | | | |
|---|---|---|---|
| 1454979 | 11/1976 | United Kingdom | 418/201 |

*Primary Examiner*—Donald O. Woodiel

*Attorney, Agent, or Firm*—Craig and Antonelli

[57] ABSTRACT

A screw compressor including a male rotor and a female rotor forming a pair, a rotor casing enclosing the pair of rotors and cooperating therewith to define a working chamber for compressing gas, a suction port and a discharge port formed in a suction cover and a discharge cover respectively provided to the rotor casing, a slide valve mounted at one part of the rotor casing for axial movement to return gas from the working chamber to the suction side of the compressor, a radial discharge port formed in the slide valve, and an axial discharge port formed in the discharge cover and smaller in size than the radial discharge port. The slide valve is formed therein with at least one gas flow passageway for communicating the working chamber with the discharge port only when the compressor operates in a controlled capacity mode.

4 Claims, 15 Drawing Figures

SCREW COMPRESSOR

BACKGROUND OF THE INVENTION

This invention relates to screw compressors and more particularly to means for improving the capacity control characteristics of a screw compressor having a slide valve for controlling capacity.

As a means for effecting control of the capacity of a screw compressor, a so-called slide valve system is known in which the rotor casing for housing screw rotors is constructed in a manner to enable a portion thereof to move axially, so that a portion of the gas in the working chamber can be passed in a bypass flow to the suction side of the compressor when capacity control is effected.

This capacity control system is described, for example, in U.S. Pat. Nos. 3,885,402 (Harold W. Moody, Jr. et al), 3,913,346 (Harold W. Moody, Jr. et al), 3,936,239 (David N. Show) and 4,062,199 (Keisuke Kawahara et al). A screw compressor having a slide valve will be outlined. In a screw compressor of this type, a pair of male and female rotors is housed in a casing and rotatably journalled by bearings mounted on suction cover and a discharge cover provided to the casing. Gas is introduced into the casing through a suction port and discharged through a discharge port after being compressed. A capacity controlling slide valve is mounted in the casing and cooperates with the male and female rotors, casing, suction cover and discharge cover to define a working chamber for compressing the sucked gas. The slide valve is capable of moving axially thereof, and when the slide valve moves axially, a portion of the gas in the working chamber is bypassed to the suction side of the compressor through a bypass passage formed between the casing and slide valve and at the same time initiaton of compression of the gas is delayed to thereby effect capacity control of the compressor. The slide valve is moved by a hydraulic piston through a slide valve drive shaft. The slide valve and the discharge cover are formed with a radial discharge port and an axial discharge port respectively.

In this type of screw compressor of the prior art, the axial and radial discharge ports are of a size such that they are compatible with an internal volume ratio $V_{iF}$ for operation at full load (the volume ratio of the theoretical maximum volume of operating chamber after gas is sealed to the theoretical minimum volume of operating chamber immediately before gas is discharged). Because of this design characteristic, the screw compressor would have the disadvantage that the size of the discharge ports does not match the operating pressure ratio of the compressor when the latter operates at partial load, thereby reducing the capacity control characteristics of the compressor.

In order to improve capacity control characteristics, two proposals have been made. One is to match the size of the radial discharge port with the internal volume ratio $V_{iF}$ for operation at full load while the axial discharge port has its size made smaller than that of the radial discharge port, so that the compressor will have a built-in volume ratio for operation at partial load $V_{iP}=V_{iF}$. The other is to use a separate special slidable valve for increasing the size of the axial discharge port, such as the one described in U.S. Pat. No. 3,314,597 (Laulitz Benedictus Schibbye), for example.

In the former, if the axial discharge port had a size such that the built-in volume ratio $V_{iP}$ for operation at partial load is equal to the internal volume ratio $V_{iF}$ for operation at full load when the slide valve is fully close, capacity control characteristics would be greater improved when the compressor operates at high capacity with small slide valve opening. However, when the compressor operates at medium capacity with a medium slide valve opening, supercompression would occur and the capacity control characteristics would rather be reduced because $V_{iP}>V_{iF}$.

The latter uses a special slidable valve, in addition to the slide valve, that can be actuated by means mounted outside the casing when the compressor operates under capacity control, while the axial and radial discharge ports have a size such that they are compatible with the internal volume ratio $V_{iF}$ for operation at full load. The special slidable valve is operative to cause a portion of the working fluid to flow to the high pressure passage side, but the mechanism for causing this flow is complex. Moreover, no satisfactory solution has been provided to meet the requirements that the built-in volume ratio $V_{iP}$ for operation at partial load should not become too low and that no supercompression should occur when slide valve opening is increased.

SUMMARY OF THE INVENTION

An object of this invention is to improve the capacity control characteristics of a screw compressor, and more particularly to avoid supercompression of gas by a screw compressor having an axial discharge port of a smaller size than a radial discharge port, when such compressor operates at medium capacity.

Another object is to provide simple means for preventing the occurrence of supercompression when the compressor operates at medium capacity.

In order to accomplish the aforesaid objects, the invention provides a feature that the slide valve is formed with at least one gas flow passage extending therethrough for communicating the working chamber for compressing gas with the discharge port only when the compressor operates at medium capacity in capacity control operation mode to thereby permit the gas to flow to the discharge side without undergoing supercompression.

Thus the present invention provides means of simple construction for avoiding supercompression of gas when the compressor operates at medium capacity which means can be readily incorporated in a commercially available screw compressor by simple machining. The screw compressor provided with this means does not show a reduction in efficiency due to an excessively low built-in volume ratio $V_{iP}$ for operation at partial load and does not cause supercompression of gas to occur when slide valve opening is increased.

The essentials of this invention reside in the provision, in a screw compressor of the type in which capacity control is effected by means of a slide valve, particularly in a screw compressor of the type described designed to have an axial discharge port smaller in size than a radial discharge port, at least one duct in the slide valve itself, the duct opening at one end in the working chamber and at the other end in the body of the slide valve. The other end of the duct opening in the body of the slide valve being positioned such that when the slide valve is actuated during operation of the compressor and moves a suitable distance, the duct communicates with the discharge port of the compressor.

The duct may be one or more than one. When a plurality of ducts are formed in the slide valve, the capacity control characteristics of the compressor can be varied with advantage by displacing the positions of the ends of the ducts which communicate with the discharge port of the compressor.

It is when supercompression of gas is initiated that the duct brings the working chamber and the discharge port into communication with each other. After communication is established between the working chamber and the discharge port, compressed gas is preferably allowed to flow quickly to the discharge port without taking more time than is necessary. To this end, it will be understood that the diameter of the duct is preferably as large as possible.

DESCRIPTION OF THE PREFERRED EMBODIMENTS

Figure 1:
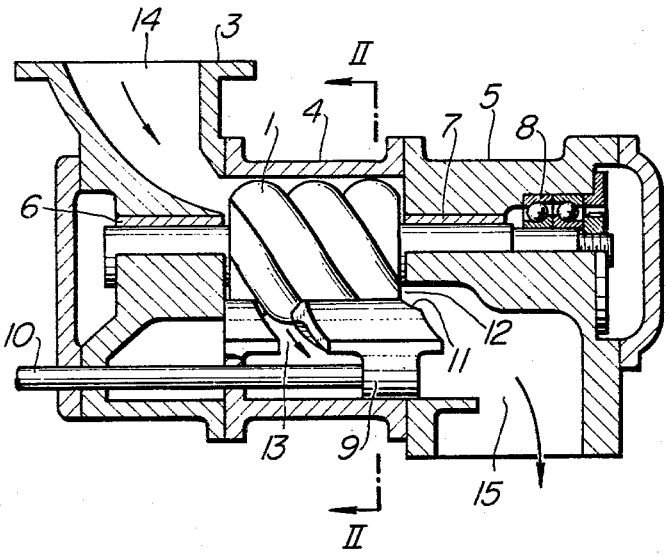
FIG. 1 PRIOR ART
FIG. 1 is a sectional elevation of a screw compressor of the prior art, taken along the line I—I in FIG. 2.
Figure 2:
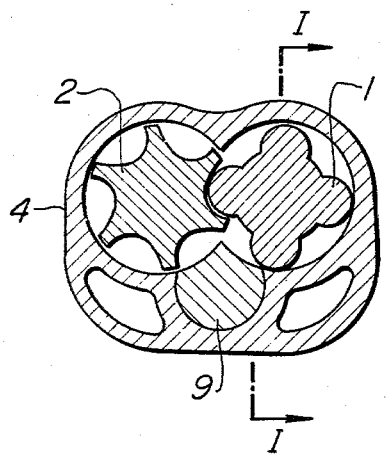
FIG. 2 PRIOR ART
FIG. 2 is a sectional view as seen in the direction of arrows II—II in FIG. 1.
Figure 3:
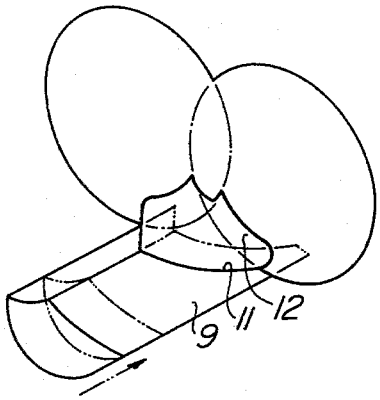
FIG. 3 PRIOR ART
FIG. 3 is a schematic view showing the slide valve of a screw compressor of the prior art in relation to the discharge port thereof.

FIGS. 1, 2 and 3 show one example of screw compressor of the prior art, wherein a male rotor 1 and a female rotor 2 forming a pair are housed in a rotor casing 4 and rotatably journalled by bearings 6, 7 and 8 arranged within the rotor casing 4 and mounted on a suction cover 3 and a discharge cover 5 provided to the rotor casing 4. A slide valve 9 for effecting capacity control is mounted within the rotor casing 4 and cooperates with the male and female rotors 1 and 2, rotor casing 4, suction cover 3 and discharge cover 5 to define a working chamber for compressing sucked gas. The slide valve 9 is connected to a drive shaft 10 axially moved by means of a hydraulic piston, not shown, and when the slide valve 9 is moved axially by the drive shaft 10, a portion of the gas in the working chamber drawn via a suction port 14 flows through a bypass flow path 13 between the slide valve 9 and rotor casing 4 to the suction side of the compressor and initiation of compression of the gas in the working chamber is delayed, thereby permitting capacity control of the compressor to be effected. The remainder of the gas in the working chamber is compressed and discharged via a discharge port 15 after flowing through a radial discharge port 11 and an axial discharge port 12 formed in the slide valve 9 and the discharge cover 5 respectively.

In a screw compressor of the prior art wherein the radial discharge port 11 and axial discharge port 12 are of a size such that they are compatible with an internal volume ratio $V_{iF}$ for operation at full load, mismatch of the discharge port with the operating pressure ratio of the compressor would occur when the compressor operates at partial load. That is, as the slide valve 9 moves from a solid line position to a two-dot chain line position in FIG. 3, when capacity control is effected, the radial discharge port 11 gradually becomes smaller in size but the axial discharge port 12 is constant in size at all times. This is responsible for the aforesaid mismatching of the discharge ports with the pressure ratio. This phenomenon will be explained by referring to the indicator diagram shown in FIG. 5. When the compressor operates at full load, the discharge ports are opened when gas of suction pressure $P_1$ is compressed from a volume $V_1$ to a volume $V_2$ to raise the pressure of gas to a discharge pressure $P_2$. However, when capacity control is effected, the discharge ports are opened when the volume of gas is compressed from $V_3$ to $V_2$ and the pressure of gas does not reach the discharge pressure $P_2$. Thus, if the radial discharge port 11 and axial discharge port 12 were designed to be compatible with the internal volume ratio $V_{iF}$ for operation at full load, then the relation between slide valve opening and a built-in volume ratio $V_{iP}$ for operation at partial load would be as represented by a curve A in FIG. 4 which shows that $V_{iP}$ gradually becomes smaller than $V_{iF}$ as slide valve opening is increased, with a result that $V_{iP}$ becomes growingly incompatible with the operating condition of the compressor. Thus the capacity control characteristics of the compressor will be reduced as capacity becomes smaller, as represented by a curve A in FIG. 6.

Figure 4:
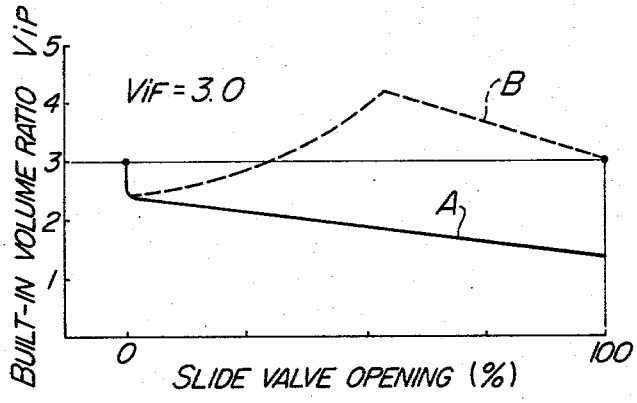
FIG. 4 PRIOR ART
FIG. 4 is a diagrammatic representation of the capacity control characteristic of a screw compressor of the prior art showing the relation between built-in volume ratio $V_{iP}$ for operation at partial load and slide valve opening.
Figure 5:
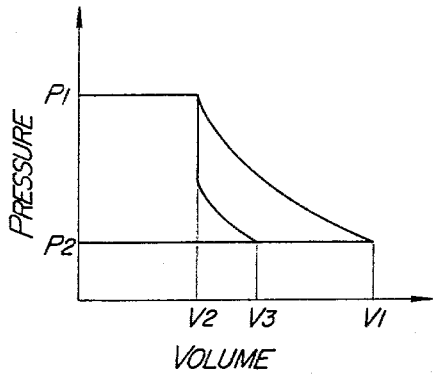
FIG. 5 PRIOR ART
FIG. 5 is an indicator diagram showing the relation between the slide valve and discharge port of a screw compressor of the prior art.
Figure 6:
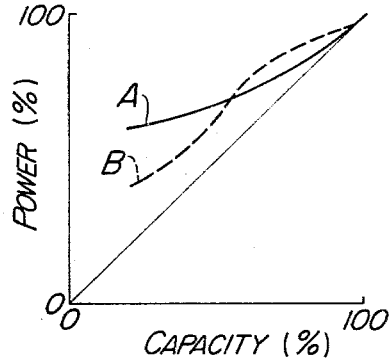
FIG. 6 PRIOR ART
FIG. 6 is a diagrammatic representation of the capacity control characteristic of a screw compressor of the prior art showing the relation between capacity and used power.

A curve B in FIG. 4 represents the relation between slide valve opening and $V_{iP}$ and a curve B in FIG. 6 represents the relation between capacity and used power which relations are established when an attempt is made to improve capacity control characteristics by matching the size of the radial discharge port 11 with the internal volume ratio $V_{iF}$ for operation at full load and making the axial discharge port 12 smaller in size than the radial discharge port 11 so that the built-in volume ratio $V_{iP}$ for operation at partial load may become equal to the internal volume ratio $V_{iF}$ for operation at full load or $V_{iP}=V_{iF}$ when the slide valve effects 100% capacity control. It will be appreciated that capacity control characteristics are greatly improved when the slide valve is slightly opened to enable the compressor to operate at nearly full capacity, but that when the slide valve is opened to a medium degree to enable the compressor to operate at medium capacity, gas undergoes supercompression because $V_{iP}$ becomes higher than $V_{iF}$ or $V_{iP}>V_{iF}$, thereby reducing capacity control characteristics.

Alternatively, if an attempt is made to improve capacity control characteristic by providing another slidable valve and increasing the area of the axial discharge port, then it would become necessary to use a mechanism of complex construction to effect capacity control.

One embodiment of the invention will now be described by referring to FIGS. 7A to 9. As shown, a slide valve 16 is mounted in the rotor casing 4 for axial movement like the slide valve 9 shown in section in FIG. 1. Other component parts of the screw compressor associated with the slide valve 16 are similar to those shown in FIGS. 1 and 2. The numerals 11, 13 and 15 designate the radial discharge port, bypass flow passage and discharge port respectively. 17 designates a gass flow passage or duct opening at one end in a working chamber defined by the male rotor 1, female rotor 2, rotor casing 4 and the like and at the other end in the body of the slide valve 16. The other end of the duct 17 opening in the body of the slide valve 16 is positioned such that when the slide valve 16 is actuated during operation of the compressor and has moved a suitable distance, the other end of the duct 17 communicates with the discharge port 15. The position of the other end of the duct 17 may also vary depending on the volume of the working chamber which is determined by the dimensions of the screw compressor or the dimensions of the female and male screws and other factors. Ideally, the other end of the duct 17 would be positioned such that when supercompression is initiated gas would flow to the discharge port 15.

Figure 7A:
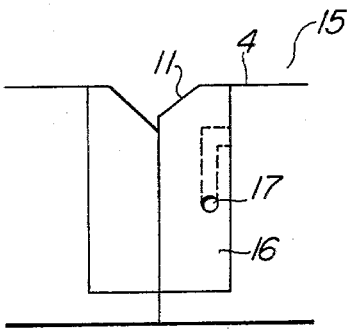
FIGS. 7A and 7B are partial views of the screw compressor comprising one embodiment of the present invention, schematically showing the process of operation of the slide valve alone.
Figure 7B:
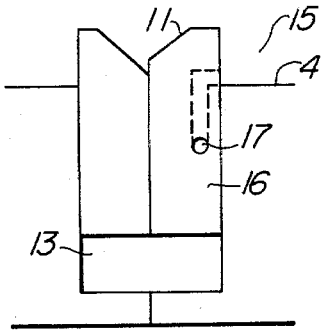

When capacity control is effected such that the compressor operates in the range from nearly full capacity to medium capacity, the other end of the duct 17 is closed by the wall of the rotor casing 4 as shown in FIG. 7A and prevented from communicating with the discharge port 15. However, when the slide valve 16 moves axially and supercompression of gas is commenced, the other end of duct 17 for gas flow opens in the suction port 15 and communication is established between the working chamber and the discharge port 15 via duct 17, thereby permitting the gas in the working chamber to flow to the discharge port 15 via duct 17 without being supercompressed.

Figure 8:
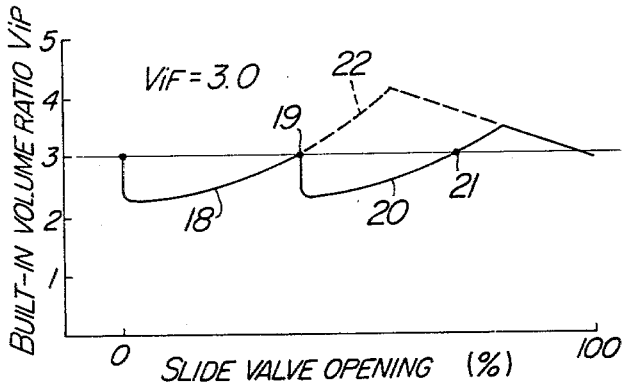
FIG. 8 is a diagrammatic representation of the capacity control characteristic of a screw compressor having an internal volume ratio $V_{iP}=3.0$ for operation at full load showing the relation between slide valve opening and built-in volume ratio $V_{iP}$ for operation at partial load which is established when the slide valve according to this invention is actuated.

The relation between the opening of slide valve 16 formed therein with the duct 17 and the built-in volume ratio $V_{iP}$ for operation at partial load is represented by a solid-line curve 18 in FIG. 8 which shows that communication is established between the working chamber and discharge port 15 via duct 17 at a point 19 at which supercompression of gas is commenced when the compressor operates at medium capacity. This makes the built-in volume ratio $V_{iP}$ for operation at partial load low, and even if the opening of slide valve 16 is slightly increased thereafter, $V_{iP}$ does not exceeds $V_{iF}=3.0$ up to a point 21 as indicated by a solid-line curve 20. A broken-line curve 22 is obtained when no duct 17 is formed in the slide valve 16, and a broken-line curve B shown in FIG. 6 represents the relation between capacity and used power established when the compressor operates as indicated by the broken-line curve 22. When the compressor operates as indicated by the curves representing improved characteristic shown in FIG. 8, used power can be further reduced as indicated by a solid-line curve C shown in FIG. 9, as compared with a broken-line curve B in the same figure corresponding to the curve B in FIG. 6.

Another embodiment will be described by referring to FIGS. 10A to 12. A slide valve 23 is formed with the aforesaid duct 17 for gas flow and another duct 24 for gas flow which, like duct 17, brings the working chamber into communication with the discharge port 15 when the slide valve 23 moves axially. Establishing of communication between the working chamber and discharge port 15 via duct 17 slightly differs in timing from establishing of analogous communication via duct 24. The provision of a plurality of gas flow passages or ducts in the slide valve has particular effect when the axial discharge port 12 is rendered very small in size. When the axial discharge port 12 has its size reduced greatly, it would be impossible to avoid supercompression of gas satisfactorily when the compressor operates at medium capacity, if only one gas flow passage were formed in the slide valve. However, the provision of a plurality of gas flow passages 17 and 24 in the slide valve 23 as shown in FIGS. 10A, 10B and 10C enables capacity control characteristic to be greatly improved as indicated by solid-line curves in FIG. 11.

Figure 9:
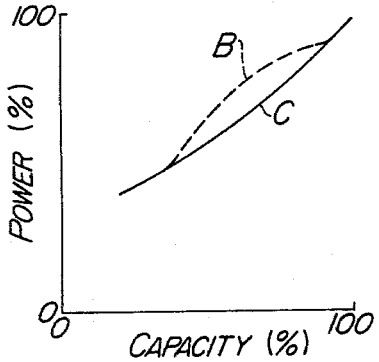
FIG. 9 is a diagrammatic representation of the capacity control characteristic showing the relation between capacity and used power established when the slide valve according to the invention is actuated.
Figure 10A:
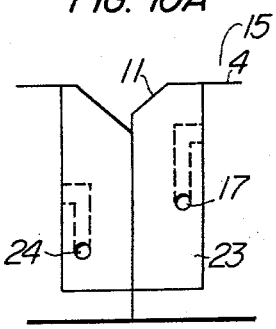
FIGS. 10A, 10B and 10C are partial views of the screw compressor comprising another embodiment of this invention, schematically showing the process of operation of the slide valve alone.
Figure 10B:
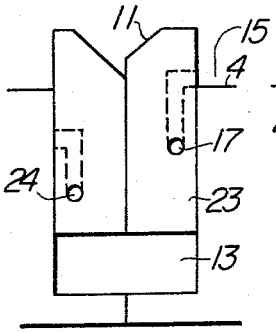
Figure 10C:
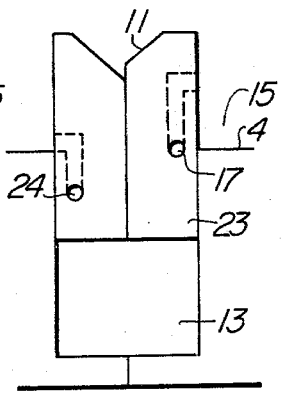
Figure 11:
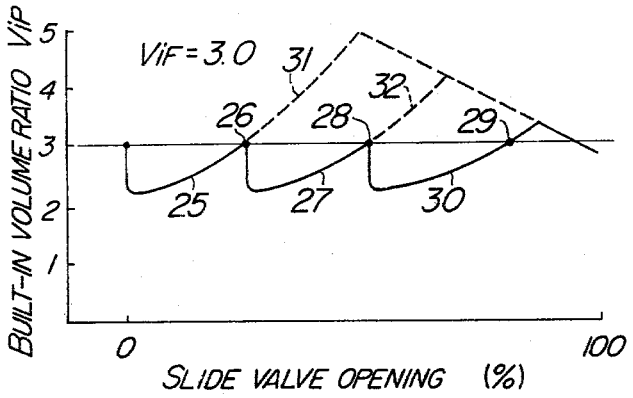
FIG. 11 is a diagrammatic representation of the capacity control characteristic of a screw compressor having an internal volume ratio $V_{iF}=3.0$ for operation at full load showing the relation between slide valve opening and built-in volume ratio $V_{iP}$ for operation at partial load which is established when a modification of the slide valve according to this invention is actuated.
Figure 12:
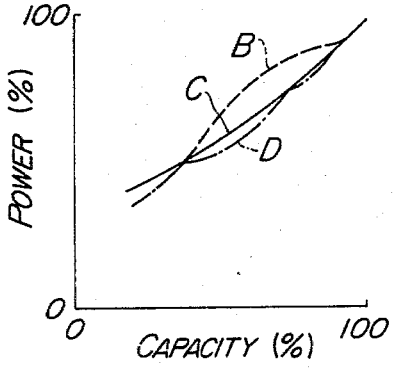
FIG. 12 is a diagrammatic representation of the capacity control characteristic showing the relation between capacity and used power which is established when the modification of the slide valve according to the invention is actuated.

More specifically, when the slide valve 23 is slightly opened to shift from operation at full load to operation at nearly full load, the ducts 17 and 24 are closed by the wall of the rotor casing 4 as shown in FIG. 10A and no communication is maintained between the working chamber and discharge port 15 via ducts 17 and 24. However, when the slide valve 23 is further moved and compression of gas is commenced, duct 17 first opens in the discharge port 15 as shown in FIG. 10B to permit the gas in the working chamber to flow through duct 17 to the discharge port 15 without being supercompressed. A solid-line curve 25 shown in FIG. 11 represents the relation between the opening of slide valve 23 and the built-in volume ratio $V_{iP}$ for operation at partial load which is established when the slide valve 23 moves as aforesaid. Since duct 17 communicates the discharge port 15 with the working chamber at a point 26 at which supercompression of gas is commenced, the built-in pressure ratio $V_{iP}$ for operation at partial load becomes low, and even if the opening of slide valve 23 is slightly increased thereafter, capacity control characteristic is as indicated by a solid-line curve 27 and the built-in volume ratio $V_{iP}$ for operation at partial load does not exceed $V_{iF}=3.0$ up to a point 28. By the time the characteristic curve passes through point 28, the other duct 24 opens in the discharge port 15 as shown in FIG. 10C, so that the gas in the working chamber flows through duct 24 to the discharge port 15 without being supercompressed. The built-in volume ratio $V_{iP}$ for operation at partial load is kept below the internal volume ratio $V_{iF}=3.0$ up to a point 29 as indicated by a solid-line curve 30. A broken-line curve 31 represents the capacity control characteristic of a compressor having no two gas flow passages or ducts 17 and 24, and a broken-line curve B shown in FIG. 12 corresponding to the curve B in FIG. 6 represents the relation between capacity and used power established when the compressor operates as indicated by the curve 31. A broken-line curve 32 represents a change in built-in volume ratio $V_{iP}$ for operation at partial load which would occur if only one duct 17 were formed in the slide valve 23. A solid-line curve C shown in FIG. 12 corresponding to the curve C in FIG. 9 represents the relation between capacity and used power established when the slide valve 23 is formed with only one duct 17. When capacity control characteristic is further improved by forming duct 24 in addition to duct 17, used power can be further reduced as indicated by a one-dot chain line curve D in FIG. 12, as compared with the solid-line curve C shown in the same figure.

From the foregoing description, it will be appreciated that according to the present invention at least one gas flow passage or duct is formed in the slide valve to communicate the working chamber with the discharge port only when the compressor operates at controlled capacity. Thus the invention enables capacity control characteristic to be improved by incorporating, in the screw compressor, means which is simple in construction and low in cost.

This invention is applied to a screw compressor of the type in which the axial discharge port is smaller in area than the radial discharge port, so that capacity control characteristics could be improved and no super-compression of gas would occur when the compressor operates both at capacity and medium capacity. Thus used power would be greatly reduced and the performance of the screw compressor would be greatly improved.

What is claimed is:

1. A screw compressor comprising:

a male rotor and a female rotor in meshing engagement with each other and forming a pair;

a rotor casing enclosing said pair of rotors and cooperating therewith to define a working chamber for compressing gas;

an axial discharge port and a radial discharge port formed such that the former is smaller in area than the latter; and a slide valve mounted at one part of said rotor casing for axial movement, said slide valve being operative to return gas from said working chamber to the low pressure side of the compressor;

wherein the improvement comprises a duct formed in said slide valve for establishing communication between the working chamber and the discharge port side of the compressor only when the compressor operates in a controlled capacity mode.

2. A screw compressor as set forth in claim 1, wherein said duct formed in said slide valve brings the working chamber into communication with the discharge port side of the compressor only when the compressor operates in a medium capacity mode.

3. A screw compressor as set forth in claim 1, wherein said duct is plural in number and said plurality of ducts open on the discharge port side of the compressor in positions displaced from each other.

4. A screw compressor as set forth in claim 3, wherein one of said plurality of ducts brings the working chamber into communication with the discharge port side of the compressor when the compressor operates in a medium capacity mode, and the other duct also communicates the working chamber with the discharge port side of the compressor when the compressor operates in a low capacity mode.

* * * * *